US005586527A

United States Patent [19]

Kreuter

[11] Patent Number: 5,586,527

[45] Date of Patent: Dec. 24, 1996

[54] DEVICE FOR THE VARIABLE CONTROL OF THE VALVES OF INTERNAL COMBUSTION ENGINES, MORE PARTICULARLY FOR THE THROTTLE-FREE LOAD CONTROL OF 4-STROKE ENGINES

[75] Inventor: Peter Kreuter, Aachen, Germany

[73] Assignee: Meta Motoren-und Energie-Technik GmbH, Herzogenrath, Germany

[21] Appl. No.: 481,245

[22] PCT Filed: Dec. 22, 1993

[86] PCT No.: PCT/DE93/01248

§ 371 Date: Jun. 9, 1995

§ 102(e) Date: Jun. 9, 1995

[87] PCT Pub. No.: WO94/16203

PCT Pub. Date: Jul. 21, 1994

[30] Foreign Application Priority Data

Dec. 30, 1992 [DE] Germany ..... 42 44 551.5
Dec. 30, 1992 [DE] Germany ..... 42 44 550.7

[51] Int. Cl.[6] ..... F01L 13/00; F01L 1/34

[52] U.S. Cl. ..... 123/90.15; 123/90.17; 123/90.31

[58] Field of Search ..... 123/90.15, 90.16, 123/90.17, 90.31

[56] References Cited

U.S. PATENT DOCUMENTS

| | | | |
|---|---|---|---|
| 3,888,216 | 6/1975 | Miokovic | 123/90.15 |
| 4,714,057 | 12/1987 | Wichart | 123/90.15 |
| 4,862,845 | 9/1989 | Butterfield et al. | 123/90.15 |
| 5,052,350 | 10/1991 | King | 123/90.16 |
| 5,111,791 | 5/1992 | Onodera | 123/432 |
| 5,163,872 | 11/1992 | Niemiec et al. | 464/2 |
| 5,199,393 | 4/1993 | Baldassini | 123/90.17 |

FOREIGN PATENT DOCUMENTS

| | | |
|---|---|---|
| 470032 | 4/1926 | Germany . |
| 3531000 | 8/1986 | Germany . |
| 57-012161 | 1/1982 | Japan . |
| 57-210109 | 12/1982 | Japan . |
| 60-091054 | 5/1985 | Japan . |
| 60-113857 | 6/1985 | Japan . |
| 288962 | 6/1928 | United Kingdom . |
| 2180597 | 4/1987 | United Kingdom . |

*Primary Examiner*—Weilun Lo
*Attorney, Agent, or Firm*—Felfe & Lynch

[57] ABSTRACT

The invention relates to a possibility for the relative rotation of two camshafts for the control of internal combustion engines, more particularly to reduce the gas exchange losses of reciprocating 4-stroke engines. The invention more particularly enables very large adjustment angles of up to 220° crank angle to be obtained.

12 Claims, 5 Drawing Sheets

DEVICE FOR THE VARIABLE CONTROL OF THE VALVES OF INTERNAL COMBUSTION ENGINES, MORE PARTICULARLY FOR THE THROTTLE-FREE LOAD CONTROL OF 4-STROKE ENGINES

BACKGROUND OF THE INVENTION

The invention relates to a device for the variable control of the valves of internal combustion engines, more particularly for the throttle-free load control of 4-stroke engines via the intake stroke functions of one or more intake valves per cylinder. Two camshafts rotate to opposite hands and act via a transmission member, more particularly a rocking lever on the or each valve spring-loaded in the closure direction, one camshaft determining the opening function and the second camshaft the closing function, so that the stroke and/or duration of opening of the or each valve can be changed in relation to one another over wide ranges by a relative rotation of the two camshafts.

Such a valve control system is known from Offenlegungsschrift DE-OS 35 31 000. In that valve drive the required variability of a valve control system, principally to avoid throttle losses, is effected by the feature that the opening and closure operation is performed by two different control cams running at a controllable phase angle to the crankshaft. A control lever of any desired construction is so actuated by the two camshafts that the valve spring-loaded in the closure direction is opened only when both control cams are extended. In this way variable valve control times can be adjusted by a suitable phase position of the camshafts. A similar valve control system for intake valves of reciprocating piston internal combustion engines is disclosed in DE-OS 35 19 319 to which U.S. Pat. No. 4,714,057 corresponds. In that case, in addition to a rotating stroke camshaft, a control camshaft rotating at the same speed engages at a displaceable bearing place of the pivotable valve lever. In principle variable valve control systems can be obtained in this way, wherein the course of the valve stroke can be so altered as to reduce the gas exchange losses caused in 4-stroke engines by throttling.

In the system disclosed in DE-OS 35 31 000 the relative rotation of the two camshafts takes place via accelerator-controlled camshaft driving wheels, which can be displaced on corresponding steep threads. Only small angles of rotation with relatively long adjustment times are also permitted by the camshaft phase adjusters, known from other Patent Specifications and Offenlegungsschriften (e.g., DE-OS 29 09 803), some of which are already in serial production, which operate on the principle of the axial displacement of a piston on a helical groove. Moreover, the prior art systems occupy a large constructional space, more particularly in the direction of the engine longitudinal axis.

To achieve throttle-free load control over the whole operating range of present-day motor vehicle 4-stroke engines, relative angles of rotation between the two camshafts of an order of magnitude of 150° to 220° crankshaft are required, if the intention is also to use the potential of optimum valve control times for maximum filling under full load over the whole speed range. Moreover, due to the demands of dynamic vehicle operation, the adjusting process must take place within very short periods of time (fractions of seconds). The adjuster itself should be of compact construction, to meet present-day spatial conditions in the engine chamber.

DE-PS 470 032 discloses a valve control system for internal combustion engines which is mainly characterized in that to control the valve two non-circular control discs are provided whose axes of rotation always maintain their position in relation to the axis of rotation of a transmission lever. The valve-actuating transmission lever takes the form of a two-part rocking lever which has a fixed pivot and which, when the two plate cams rotate in relation to one another, can correspondingly change within narrow limits only the duration of opening or closing of the valves, but not the valve stroke. It is a so-called OR circuit wherein the valve stroke is always determined by the control disc having the maximum operative stroke circle. To avoid jumpy functioning with consequent impermissibly high accelerations in valve operation when the two control discs rotate in relation to one another, a transition from one control disc to the other can in fact only be made with a constant operative stroke, essentially with the maximum stroke. As a result, the usable adjustment range of that system is heavily limited and unsuitable for throttle-free load control. The epicyclic gear for driving a control disc as disclosed in this citation is at the same time used to rotate the two control discs in relation to one another. The epicyclic gear consists of four toothed wheels, of which two toothed wheels are disposed on the parallel shafts of the two control discs and are driven via two further serially connected intermediate wheels. The two intermediate wheels are borne by a movable arrangement of links which gives them an epicyclic motion. The arrangement of links consists of three individual links, of which two links each connect a toothed wheel disposed on the shafts of the control discs to an intermediate wheel, while the third link interconnects the two first-mentioned links. The two links are however not connected to the pivots of the two intermediate wheels, but at some distance therefrom. However, this arrangement of the third link permits an adjustment of the epicyclic gear only when the links bearing the intermediate wheels, the third link and a plane lying in the axes of rotation of the two control discs are disposed parallel with one another. The arrangement of the links of the epicyclic gear must in practice have the shape of a parallelogram, since only in that case do the distances of the two opposite links remain identical for every position of the arrangement of links, something which for this kind of arrangement of links is the basic precondition for the satisfactory functioning of the meshing gear wheels. As a result, of course, the diameters of the four engaging gear wheels are directly dependent on one another, the transmission ratios between the toothed wheels disposed on the shafts of the control discs and the intermediate wheels being predetermined within close limits. More particularly, the diameters of the toothed wheels cannot be freely selected to influence the sensitivity of the angle of rotation of the control shaft to be rotated.

SUMMARY OF THE INVENTION

It is an object of the invention to provide a 4-wheel coupled gear for the variable control of the valves of internal combustion engines which, with an inexpensive construction and small overall size, so prevents changes of contact occurring in all the toothed wheels of the coupled gear that toothed wheel rattle and damage to the pairs of toothed wheels of the coupled drive are obviated.

According to the invention, the driving and driven shafts of the coupled gear are interconnected via an additional gear with a wheel pairing having different operative diameters and at least one frictional connection in the gear, so that a drag force is generated which is superposed on the alternating forces transmitted by the valve drive.

The different operative diameter of the additional wheel pairing in relation to the operative diameter of the wheels of the coupled gear generates in cooperation with the frictional connection essential to the invention a drag force which reliably prevents changes of contact and the problems arising therefrom.

Preferably a device according to the invention is intended to provide throttle-free load control in 4-stroke engines throughout the whole operating range. The preconditions for this are in the first place met by the feature that the valve stroke, more particularly of the inlet valves, can be steplessly adjusted from zero stroke to maximum stroke with adequate variability of the closure control times. The device provided for this purpose operates after the fashion of an incremental gear, wherein the valves spring-loaded in the closure direction are opened only when two camshafts rotating at the same speed engage by their stroke functions via the associated pickup elements of a transmission member, more particularly a lever. One camshaft determines the opening function of the valve, while the other camshaft determines its closure function. The stroke and/or duration of opening of the valves can be changed over wide ranges by rotating the two camshafts concerned in relation to one another.

For this purpose the two camshafts engage with one another according to the invention via a 4-wheel coupled gear, one wheel of the coupled gear being rigidly connected to the first camshaft driven by the crankshaft and via the two intermediate wheels driving the driven wheel and therefore the second camshaft. In contrast with DE-PS 470 032, however, the wheels of the gear are each borne in their pivots by the couplers, thus creating additional degrees of freedom in the geometric layout of the gear. The individual couplers are constructed in the form of simple bowed members in one or more parts, the first coupler being preferably rotatably mounted by one end on the driving camshaft and bearing by its other end a shaft on which the first intermediate wheel and the second coupler are borne. The second coupler, which can also be constructed in the form of a simple bowed member, so interconnects the two shafts, acting as pivots, of the first and second intermediate wheel that both wheels can mutually drive one another. Again, the third coupler has at one of its ends the pivot of the second intermediate wheel while by its other end it is so pivotably mounted and suspended on the second camshaft that the second intermediate wheel drives the driven wheel, also disposed on said camshaft, of the coupled gear. When the couplers are adjusted by rotation around the pivots of the rigidly casing-attached camshafts, due to the principle of the construction a large angle of rotation of the driven camshaft in relation to the driving camshaft is set up by the fact that the angle of rotation of the crank gear is superposed by the rolling-down on one another of the gear wheels of the coupled gear. To accommodate this adjusting mechanism, the cylinder head need be lengthened by only approximately the required spur gear wheel width, without any additional axial constructional space being required for the adjusting path itself. Due to the superposing of the adjusting path of the coupler and the rolling-down of the gear wheels on one another, the adjusting path transversely of the engine longitudinal axis is very small. Moreover, due to the small adjusting paths of the coupled gear, adjustment can be performed in a problem-free manner within the necessary short times, using suitable actuators.

DETAILED DESCRIPTION OF THE PREFERRED EMBODIMENTS

Figure 1:
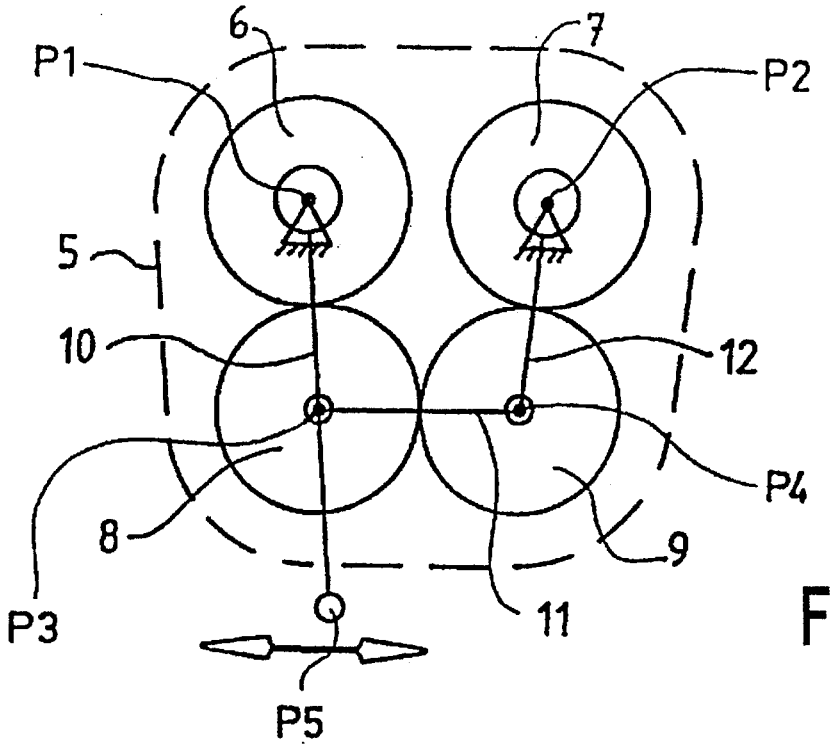
FIG. 1 a diagrammatic view of the adjusting mechanism according to the invention, FIG. 2 an illustration of the principle of a twin-camshaft valve drive for the variable control of disc valves as set forth in the preamble of the Application, FIG. 3 a diagrammatic illustration of the adjusting mechanism with overlapping gear wheels, FIG. 4 a possible way of clamping the adjusting mechanism, FIG. 5 a diagrammatic illustration of an additional phase adjuster in combination with the adjusting mechanism according to the invention, and FIGS. 6–11 different combinations for driving the camshafts of a triple camshaft engine from the crankshaft and the arrangement of the coupled gear according to the invention.

An adjusting mechanism shown basically in FIG. 1 and taking the form of a coupled gear (5) is a combination of a four-member crank gear comprising three rotatably interconnected couplers (10), (11) and (12) having two rigidly casing-attached pivots (P1) and (P2), and a wheel gear whose four serially connected and mutually driving gear wheels (6), (8), (9) and (7) are mounted on the pivots (P1), (P3), (P4) and (P2) of the crank gear. Preferably the 4-wheel gear takes the form of a toothed wheel gear. The driving wheel (6) is rigidly connected to first camshaft (1) of the known device for variable control, driven by the crankshaft, and drives the intermediate wheel (8) borne by the first coupler (10). The intermediate wheel (8) is connected via a second coupler (11) to a further intermediate wheel (9), which it drives. Via coupler (12) the intermediate wheel (9) is suspended on a driven wheel (7) attached to the second camshaft (2) of the valve drive, so that by this means finally the second camshaft is driven to the opposite hand from the first camshaft. The requirement for the two camshafts to have the same speed means that at least the driving wheel (6) and the driven wheel (7) rigidly connected to the camshafts have the same operative diameter.

When, for example, the coupler (10) rotates around the rigidly casing-connected pivot (P1) which can advantageously coincide with the axis of rotation of the driving camshaft, the driven wheel (7) and the second camshaft (2) rigidly connected thereto (FIG. 2) are rotated in relation to the first camshaft (1) (FIG. 2) by the superposed movement of the crank gear and the rolling-down of the wheels of the wheel gear on one another. In the first place it is immaterial for the adjustment itself at what place of the coupled gear the adjusting operation is initiated. Since the intermediate wheels (8) and (9) are guided in the pivots (P3) and (P4) of the three couplers, the distance of the four engaging gear wheels remains unchanged in all positions of the couplers, even if the crank gear, as shown in FIG. 1, does not take the form of a parallelogram. As a result, additional degrees of freedom are opened up in the design of the gear, more particularly as regards the diameters of the gear wheels, the distance between the driving camshaft and the camshaft to be driven and, in dependence thereon, the lengths and positions of the couplers in relation to one another.

Figure 2:
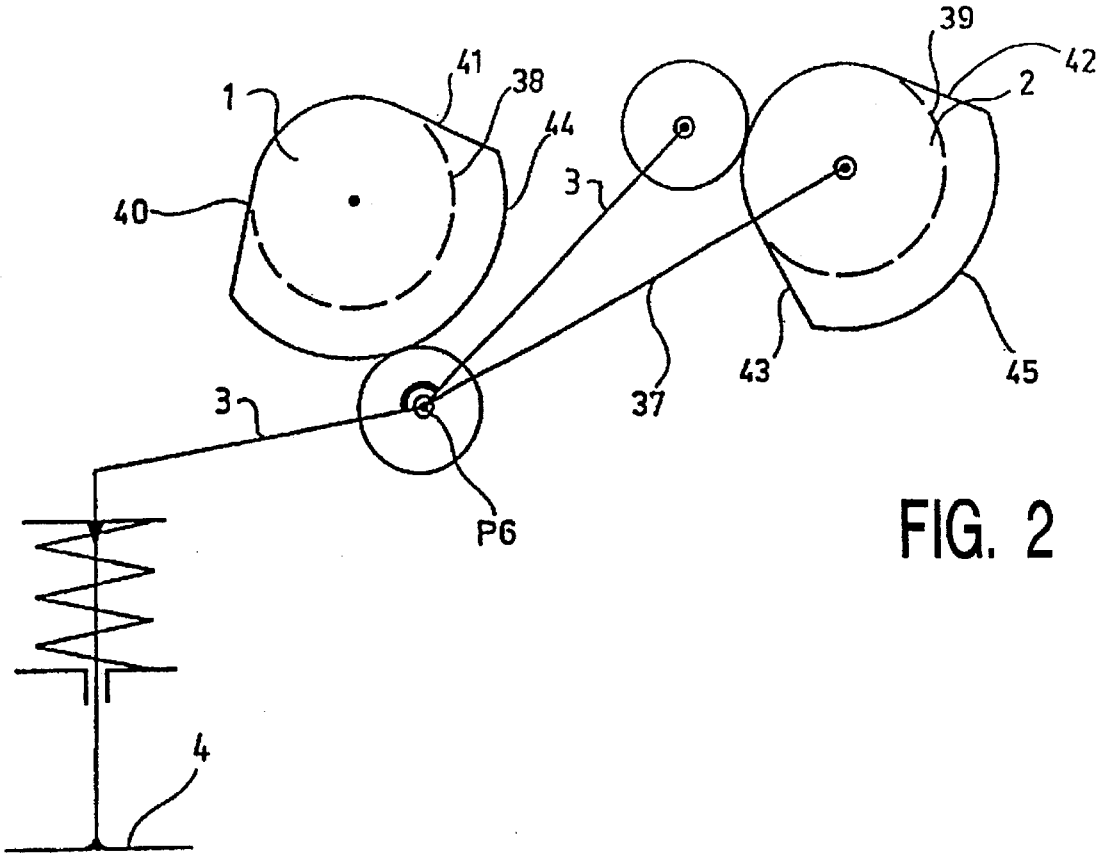

FIG. 2 shows diagrammatically a twin camshaft valve drive in which control times can be obtained with disc valves by means of the adjusting mechanism according to the invention. The device consists of two camshafts (1, 2) which rotate at the same speed and whose cams act via suitably shaped pickup members on a rocking lever (3). The rocking lever (3) transmits its motion to a conventionally constructed valve (4) spring-loaded in the closure direction. Due to the superposed course of motion of the rocking lever (3) it cannot be mounted directly on a rigidly casing-attached pivot, but must be guided by other suitable steps. As shown in FIG. 2, it is guided, by way of example, via an articulated lever (37) which, as shown in this instance, is articulated to the rocking lever (3) by one end at the central point of a pickup member following the camshaft (1), being pivotably mounted by its other end in the centre of the camshaft (2). This system operates by a so-called AND connection. The valves are opened only when both camshafts (1, 2) act by their stroke functions on the rocking lever (3). To make things clearer, the course of motion will now be described for any required configuration and a course of valve stroke:

Let it be assumed by way of example that as shown in FIG. 2 the camshaft (1) is the opening shaft rotating clockwise and the camshaft (2) is the closure shaft rotating anticlockwise. The two camshafts each have profiles made up by base circles (38, 39), stroke circles (44, 45) and ascending cam flanks (40, 42) and descending cam flanks (41, 43). The operation starts by the camshaft (2) acting by its stroke circle (45) on the rocking lever (3), without the valve (4) opening, as long as the camshaft (1) is still acting by its base circle (38) on the rocking lever (3). Only when the camshaft (1) contacts the rocking lever (3) by its stroke flank (40) does the valve (4) begin to open. Then, as soon as the camshaft (2) acts by its descending flank (43) on the rocking lever (3), a superposed rotary movement of the rocking lever, now mainly operating as a tipping lever, starts around the momentary point of contact with the camshaft (9), such movement initiating the closure operation of the valve (4). The valve is completely closed when the camshaft (2) again acts by its base circle (39) on the rocking lever (3). The following transition of the camshaft (1) from the stroke circle (44) to the base circle (38) is insignificant for the course of valve opening. The course of the valve stroke can therefore be continuously adjusted from zero stroke up to extremely long durations of operation with maximum stroke by the stepless rotation of the camshaft (2) in relation to the camshaft (1). At the same time, the smallest valve strokes with very short durations of opening can be adjusted by the camshaft (2) being so rotated by means of the aforedescribed coupled gear (5) in relation to the camshaft (1) and correspondingly to its direction of rotation that, as the camshaft (1) is starting to open the valve (4) by its ascending flank (4), the camshaft (2) already completes the superposed closure process by its descending flank (43). In very long durations of valve opening with maximum stroke, the camshaft (2) must be so far adjusted contrary to its direction of rotation that the camshaft (2) initiates the closure process by its transition from the stroke circle (45) to the descending flank (43) only after the opening camshaft (1) acts by its stroke circle (44) on the rocking lever (3), so that the valve (4) is completely opened. With the coupled gear according to the invention an adjustment range of 150° to 220° crank angle, appropriately usable with this valve operation, can be advantageously obtained with comparatively small adjustment paths. Of course, this coupled gear can also be used for the solution of other comparable problems, in which a first shaft is to be driven to the opposite hand from a second shaft and rotated in relation thereto.

Figure 6:
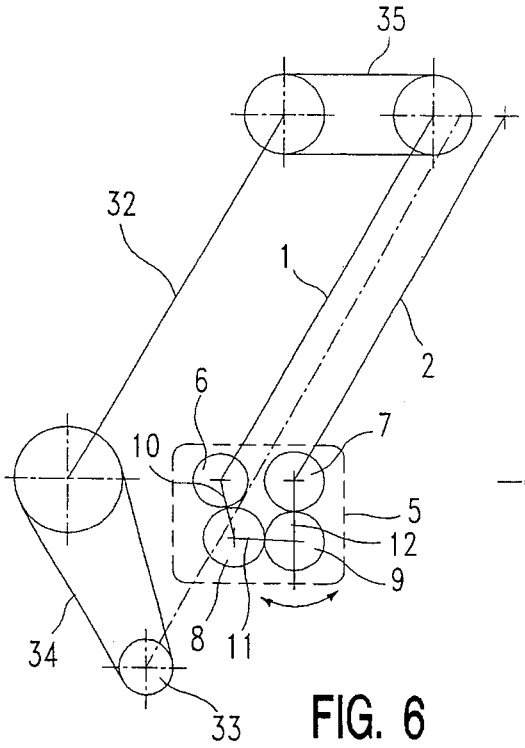
Figure 7:
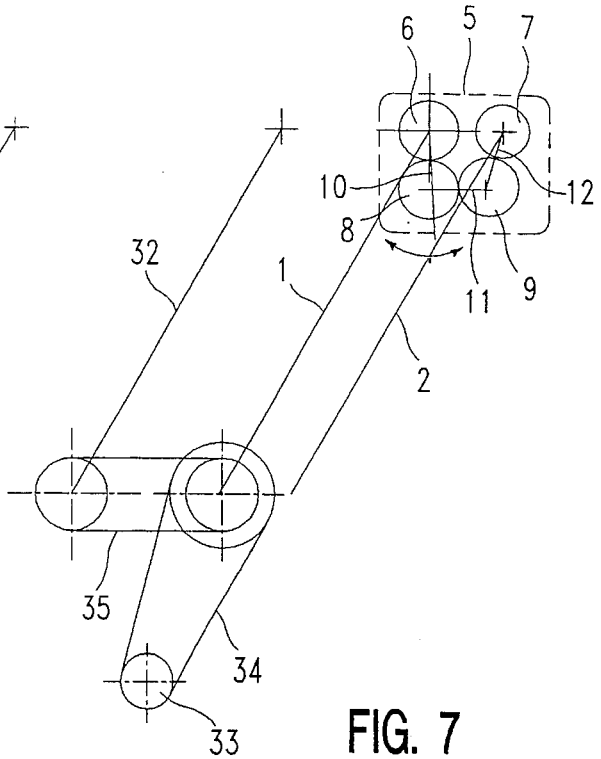
Figure 8:
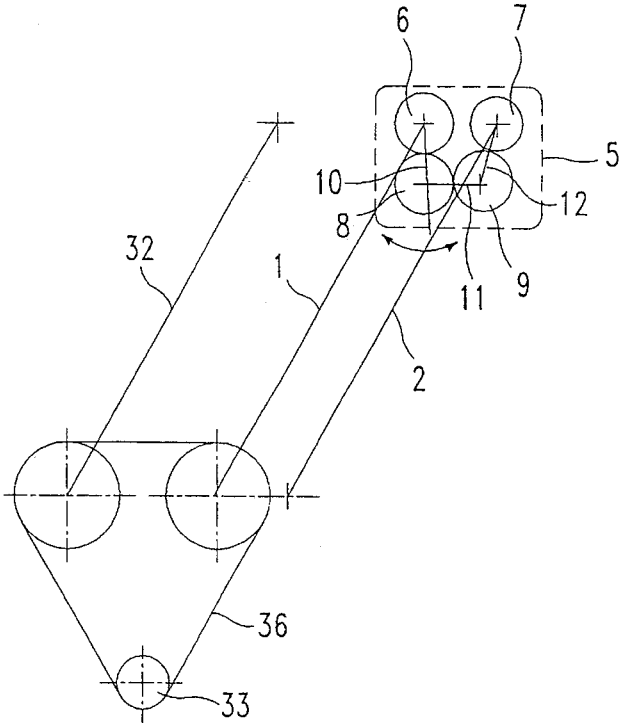

The coupled gear (5) can be disposed with its driving wheel (6) and driven wheel (7) directly on the camshafts (1) and (2) of the previously described variable valve drive, and the direction of rotation of the camshafts and the association as regards the opening and closure functions can be determined as desired. Since preferably the two camshafts are provided to actuate the intake or exhaust valves of a top-scavenged internal combustion engine, at least one additional control shaft must be provided for controlling any other valves not actuated by the aforedescribed variable valve control system. The result is various possible combinations, shown by way of example in FIGS. 6, 7 and 8, for the driving of in that case at least three camshafts by the crankshaft and the arrangement of the coupled gear. FIG. 6, shows corresponding to FIG. 2 a combination in which a third shaft (32), usually the exhaust camshaft, not responsible for the variably controllable valves, is driven by crankshaft (33) via a suitable transmission element (34), for example, a toothed belt or a chain. Via an intermediate drive (35), which can also take the form of a toothed belt or chain drive or a toothed wheel gear, the camshaft (32) drives that camshaft (1) of the variable valve drive which is not to be rotated. In that case the camshaft (2) is driven and adjusted by means of the aforedescribed coupled gear (5). As shown in FIG. 7, the camshaft (1) of the variable valve drive is directly driven via a corresponding drive (34) by the crankshaft (33) and itself drives a third camshaft (32) via a transmission element (35) and via the camshaft (2) to the opposite hand via coupled gear (5). FIG 8 shows a possible way of abandoning any extra intermediate drive and driving the two control shafts (1) and (32) not to be rotated by means of a common driving means (36). In the aforedescribed possibilities for the driving of the camshafts by the crankshaft, the driving means and also the coupled gear according to the invention can each in accordance with marginal conditions be disposed as desired at the two end faces of the engine and/or at a suitable place inside the engine constructional space.

Figure 9:
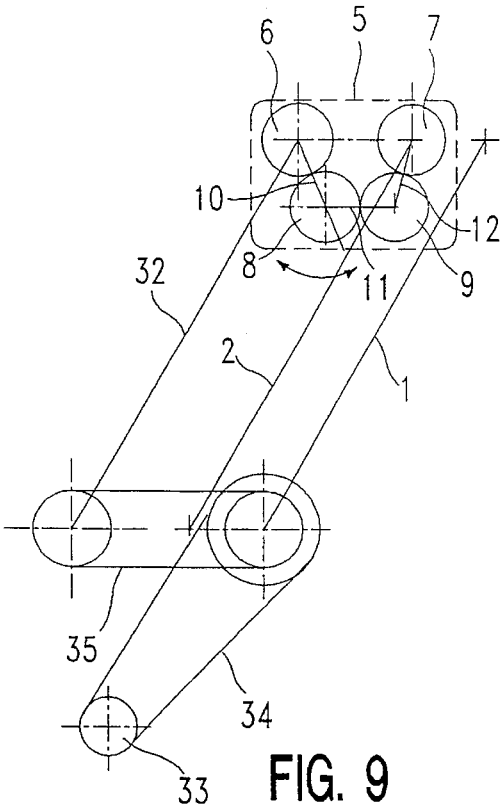
Figure 10:
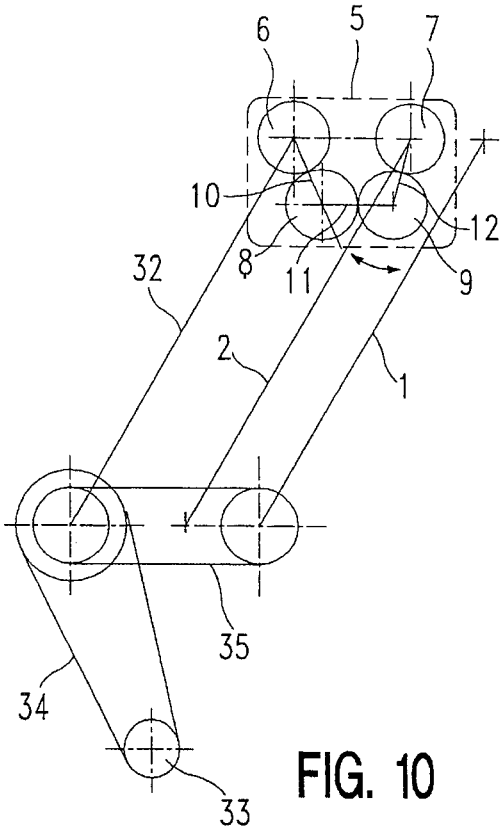
Figure 11:
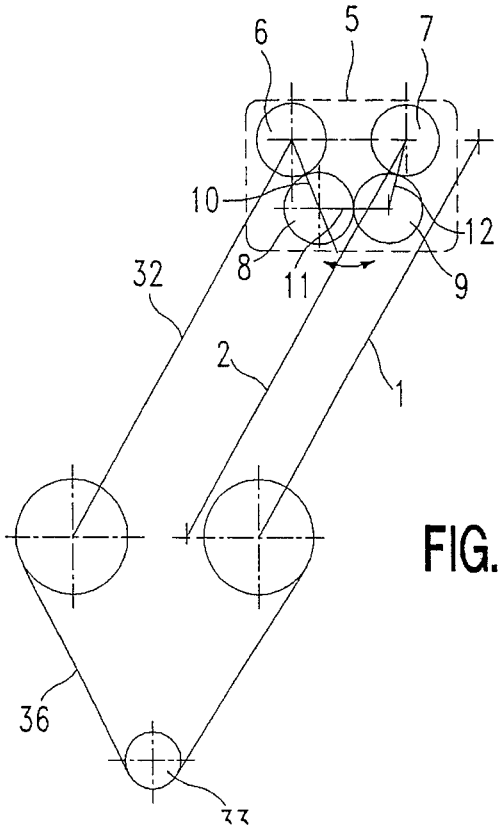

In accordance with FIGS. 9–11 it may be convenient for the driving wheel (6) of the coupled gear (5) to be disposed on a third shaft (32), also rotating at the speed of the camshaft, and from that place via the intermediate wheels (8) and (9) and the driven wheel (7) driving the camwheel (2) to be rotated of the device for the variable control of the valves. Any exhaust camshaft which may be present is also suitable for this purpose. FIGS. 9, 10 and 11 show also in this respect different possible combinations for the driving of the camshafts by the crankshaft and the arrangement of the adjusting gear in a triple crankshaft engine. In this case, the camshaft (1) not to be rotated can be driven by the crankshaft (33) by suitable driving means (34), for example, a chain (FIG. 9), or via suitable intermediate drives (35) by the third shaft (32) driving the coupled gear (FIG. 10), or via a common driving means (36) together with the shaft (32) bearing the driving wheel (6) of the coupled gear (5) (FIG. 11). The camshaft can be driven via suitable driving means, for example, a toothed belt or chain, by the crankshaft direct or indirectly via an intermediate shaft. The indirect drive via a centrally disposed intermediate shaft may be of particular advantage, for example, in the case of V-type engines.

Preferably the adjusting mechanism is so arranged that the camshaft (2) to be driven via the coupled gear (5) determines the closure function of the or each valve, so that a relative rotation of the camshaft produces a change in the valve closure time. In this way when the device is used on the intake side, unthrottled load control of 4-stroke engines is rendered possible by the clearly-defined closure of the or each intake valve at a point in time after the required quantity of charge has been sucked in by the piston. With very low loads this means that the intake valve is closed prematurely, during the downward movement of the piston in the intake phase, with correspondingly low maximum strokes. This arrangement also permits load control via late closure of the or each intake valve, during which the excess quantity of charge already sucked in by the piston is again expelled during the subsequent compression phase. The exhaust side application of the device enables the residual gas component in the fresh mixture to be purposefully controlled by changing the exhaust closure time.

In addition, by means of the aforementioned device it is also possible to control in a directed manner the opening time of the or each valve if the camshaft (2) driven by the coupled gear (5) determines the opening function. In this way on the intake side by controlling in a directed manner the intake opening time the residual gas content can be adapted in an optimum manner to the particular operational conditions, and on the exhaust side expansion work can additionally be utilized, depending on the operating point.

The geometrical design of the coupled gear determines to an important extent the sensitivity of the angle of adjustment of the camshaft (2) to be rotated. The transmission ratios between the driving and driven wheels and the intermediate wheels and the relative position of the couplers dependent thereon provide suitable parameters for designing the gear in the optimum manner for the particular application. The adjustment path of the coupled gear is understood to mean each externally initiated change in position of the couplers (10), (11) and (12) which finally adjusts the driven camshaft in relation to the driving camshaft with a corresponding transmission ratio.

As shown in FIG. 1, the adjustment path and therefore the change in position can be initiated, for example, as a rotary movement around the rigidly casing-attached pivot (P1) of the coupler (10) by means of an adjusting mechanism engaging at point (P5) with a prolongation of the coupler 10. Adjustment can equally well be initiated on the two other couplers. For the adjustment itself, various actuators are suitable such as, for example, hydraulically or pneumatically actuated linear adjusting cylinders or electrically actuated d.c. motors having a correspondingly adapted transmission. The sensitivity of the angle of rotation to the change in position initiated in the coupled gear can be influenced by the distance between the point of articulation (P5) and the rigidly casing-attached pivots (P1) and (P2) of the couplers (10) and (12) (a larger distance results in lower sensitivity and vice versa). The value of the resulting angle of rotation is decided not only by the adjustment path of the coupled gear, but also by the transmission ratio between the driving wheel (6) and the driven wheel (7) on the one hand and the intermediate wheels (8 and 9) on the other. Thus, an increase in the operative diameter of the intermediate wheels (8) and (9) in relation to the driving and driven wheels causes an increase in the angle of rotation of the camshaft (2) to be rotated for the same adjustment path of the coupled gear; a reduction of the diameter of the intermediate wheels reduces the sensitivity of the camshaft rotation and therefore of change in the control time. A further parameter is represented by the angular position of the couplers in relation to one another, which is determined in the last resort by the diameters of the four gear wheels in contact with one another and the distance between the driving camshaft and the driven camshaft. A crank drive constructed as a parallelogram, produces a linear dependence of the angle of rotation of the camshaft (2) to be rotated on the initiated adjustment path, so that in every position of the coupled gear the angle of rotation is a constant multiple of the initiated angle of rotation around the point (P1). When the crank drive deviates from the shape of a parallelogram, a varying degree of non-linear dependence can be achieved between the angle of rotation of the camshaft (2) to be rotated and the initiated change in position. This can be achieved both by differences in diameter between the intermediate wheels (8) and (9) on the one hand and the driving wheel (6) and the driven wheel (7) on the other, and also by the distance of the pivots (P1) and (P2) from one another. While on condition that the two contacting control shafts have the same speeds, the driving wheel and the driven wheel must in any case have identical diameters, the two intermediate wheels can certainly be constructed with different operative radiuses of engagement.

Very large angles of rotation are permitted with only small initiated changes in position, of the coupler (10) by a construction of the coupled gear, more particularly in the zone of an extended position of two adjacent couplers, for example, with an angle between 150° and 180° enclosed by the couplers (11) and (12).

Figure 3:
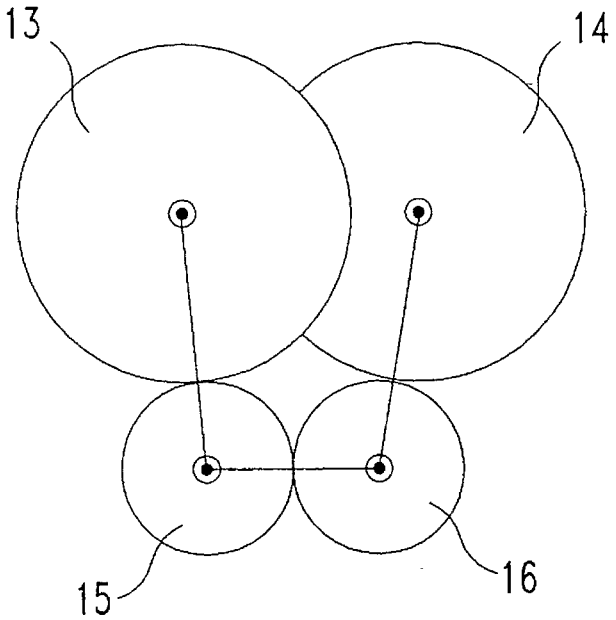

With an overlapping construction of the gear wheels (13) and (14) rigidly connected to the camshaft, according to FIG. 3, the advantages of a space-saving arrangement of the camshafts close beside one another are combined with a reduction of the forces operative on the tooth flanks by increasing the size of the gear wheels (13) and (14) associated with the camshafts. For such a construction of the adjusting gear it is moreover advantageous to construct in two parts one of the two overlapping gear wheels (13 or 14) and dispose said wheel symmetrically of the other shaft wheel, so that both the one-part shaft wheel and also the intermediate wheel (15) or (16) associated therewith can dip into the two-part spur toothed wheel during the adjustment operation. In this way undesirable forces perpendicular to the axes of rotation can be avoided with an overlapping construction.

Due to the alternating forces resulting from the excitations of the valve drive, in a coupled gear of the construction specified, namely a toothed wheel gear, changes of contact may occur which may finally lead to increased noise excitation (toothed wheel rattle) and even to damage to the pairs of toothed wheels. It may therefore be convenient to prevent such changes of contact by additional steps. In the case of helical toothed wheels this can be done by at least one of the toothed wheels being axially divided and clamped in relation to the tooth flanks of the toothed wheel meshing therewith. The clamping can be performed, for example, mechanically by means of springs or else hydraulically.

Figure 4:
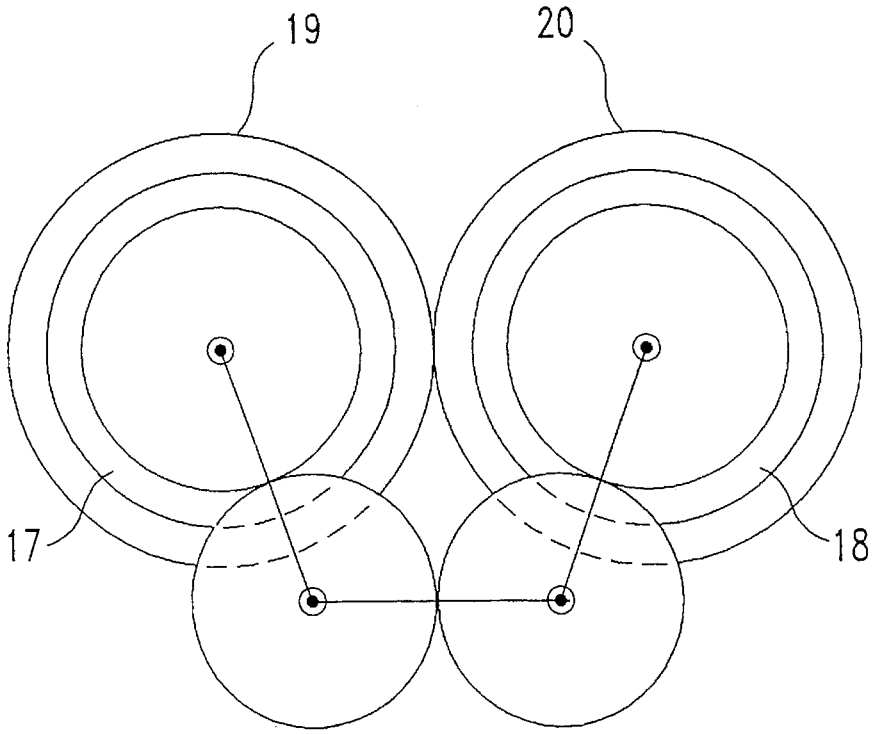

The adjusting gear can also be clamped, via an additional gear with frictional connection which connects to one another the driving camshaft, and the camshaft to be driven and rotated, via a pair of wheels having different operative diameters. Such a slight difference in diameter generates a drag force which is superposed on the alternating forces transmitted by the valve drive and thus, as a resulting pulsating force without zero passage, prevents any change of (toothrattle) in the coupled gear. This additional gear can be constructed either as a friction wheel pairing or as a toothed wheel gear with frictional connection. FIG. 4 shows a possible way of clamping the adjusting gear via a friction wheel pairing. In addition to the drive of the second camshaft via the 4-wheel coupled gear, the two shafts (17) and (18) are in contact via two friction wheels (19) and (20) rigidly connected thereto. The two friction wheels (19) and (20) are constructed with slightly different diameters, the result being a braking or forward torque between the driving camshaft and the driven camshaft, this finally leading to a clamping of the adjusting gear and preventing a change of contact on the tooth flanks.

Figure 12:
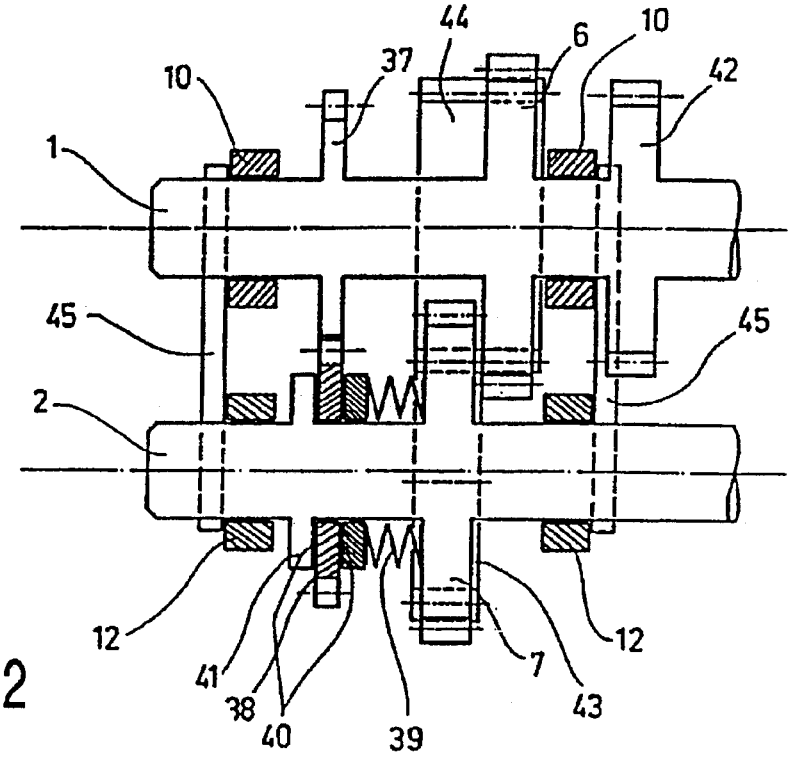
FIG. 12 is a partial section illustrating a drag mechanism for preventing change of contact in the coupled gear teeth.

FIG. 12 discloses a possible way of generating a forward or braking torque via an additional toothed wheel pairing

(37) and (38), thereby counteracting a change of contact in the coupled gear. By way of example, as shown in FIG. 12, camshaft (1) is driven by the crankshaft via a wheel (42). Also attached to the camshaft (1) is the driving wheel (6) of the coupled gear, which via intermediate wheels (43) and (44) drives the driven wheel (7) positively connected to camshaft (2) to the other hand. FIG. 12 also shows the two couplers (10) and (12) bearing the intermediate wheels and also connecting couple (11). The two additionally meshing toothed wheels (37) and (38) have slightly different numbers of teeth, thus generating a differential speed as between the toothed wheels. Since the toothed wheel (37) is positively connected to camshaft (1), the differential speed must be compensated by a frictional connection to the camshaft (2). In the embodiment illustrated this is done by the toothed wheel (38) being clamped by means of a clearly-defined force, for example, by means of a spring (39), which can take the form of a cup spring, against a collar disposed positively on the camshaft (2), thus rendering possible a relative movement between the camshaft (2) and the toothed wheel (38) at the place of contact.

Figure 5:
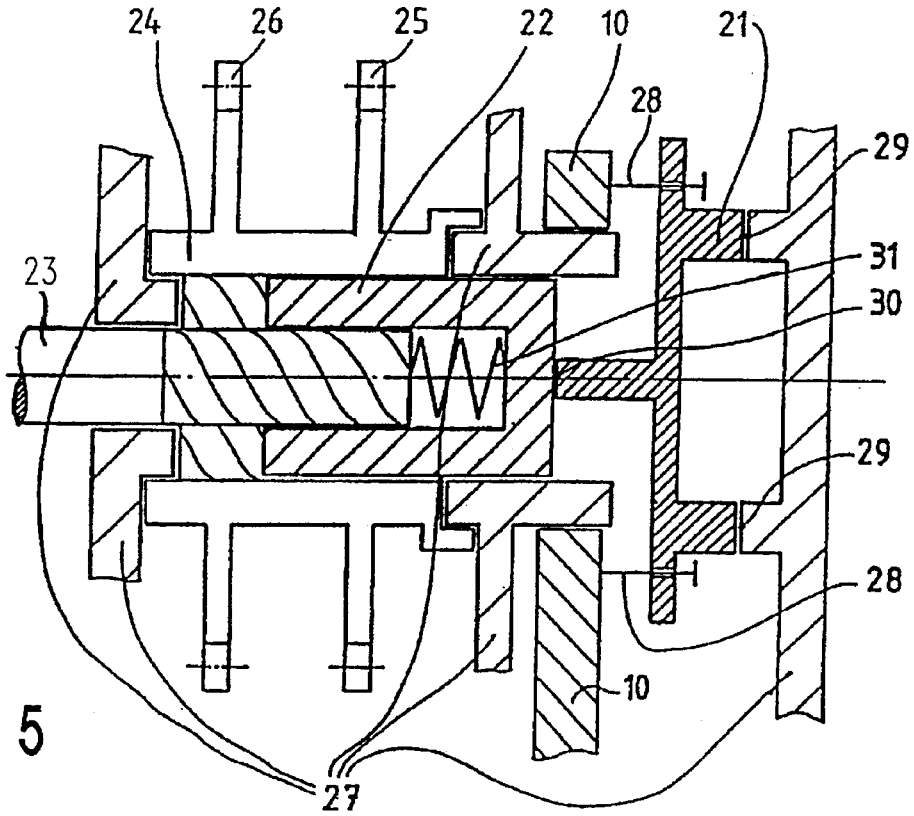

Since by means of the coupled gear only one of the two camshafts of the device for the variable control of internal combustion engine valves is phase shifted in relation to the crankshaft, it may be sensible and convenient to adjust the other camshaft also within sensible limits in relation to the crankshaft by means of an additional device. This offers, for example, the possibility of changing not only the closure times of the or each valve for throttle-free load control, but also the opening control times, thereby suitably adapting the residual proportion of gas in the fresh mixture to the particular operating conditions. FIG. 5 shows diagrammatically the adjusting mechanism according to the invention combined with an additional phase adjuster. The coupler (10) forms part of the coupled gear, which can be adjusted rotatably by an actuator in relation to the frame (27), thus producing a phase shift of the second camshaft, which is to be driven. At the same time an axial cam disc (21) is corotated by a positive connection to the coupler (10), for example, via pins (28). The axial cam disc (21) follows matching axial surfaces (29) rigidly attached to the frame, the result being an axial movement of the axial cam disc (21). This movement is transmitted via contact point (30) to entraining sleeve (22) which is internally and/or externally helically toothed to opposite hands. The spring (31) secures the non-positive connection at point (30) and urges the entraining sleeve (22) to one end position. The entraining sleeve (22) represents the positive connection between the drive wheels (25) and (26), driven directly or indirectly by the crankshaft, and the camshaft (23) to be driven by the coupled gear. Cooperation of the helical toothings between the entraining sleeve (22) and the driving element (24) and also the camshaft (23) produces a relative displacement rotations between the driving element (24), which is rigidly connected to the driving wheels (25) and (26), and the camshaft (23). The axial camming function of the axial cam disc (21) and the frame (27) can produce both forwardly and rearwardly rotating relative adjustments, as required, more particularly in respect of the intake opening time in connection with the intake closing time.

I claim:

1. Apparatus for variable control of valves in an internal combustion engine having a crankshaft, said apparatus comprising first and second camshafts having fixed axes and acting on a rocker lever when in turn acts on a spring loaded valve, gear means for phase-shifting said second camshaft relative to said first camshaft, said gear means comprising a driving wheel driving said first camshaft and driven by said crankshaft, a first intermediate wheel driven by said driving wheel, a second intermediate wheel driven by said first intermediate wheel, and a driven wheel driving said second camshaft and driven by said second intermediate wheel, said first and second intermediate wheels having moveable axes, whereby moving said axes of said intermediate wheels phase-shifts said second camshaft relative to said first camshaft, and drag means comprising a pair of engaged wheels having different operative diameters mounted on respective first and second camshafts, and friction means effective between one of said pair of wheels and one of said camshafts, thereby generating a drag force which is superposed on the force transmitted to the second camshaft by the driven wheel.

2. Apparatus as in claim 1 wherein said pair of engaged wheels are fixed to respective camshafts and have circumferential surfaces which engage frictionally.

3. Apparatus as in claim 1 wherein said pair of engaged wheels are gear wheels having different numbers of teeth, said friction means being effective between one of said engaged wheels and the camshaft to which said one of said engaged wheels is mounted.

4. Apparatus as in claim 3 wherein the other of said engaged wheels is fixed to the camshaft to which the other of said engaged wheels is mounted.

5. Apparatus as in claim 1 further comprising a first coupling link connecting the axis of the first intermediate wheel to the axis of the first camshaft, a second coupling link connecting the axis of the second intermediate wheel to the axis of the first intermediate wheel, and a third coupling link connecting the axis of the second camshaft to the axis of the second intermediate wheel.

6. Apparatus as in claim 5 wherein said first and third links are parallel in every position of said intermediate wheels.

7. Apparatus as in claim 1 wherein said driving wheel and said driven wheel are axially offset.

8. Apparatus as in claim 7 wherein one of said driving wheel and said driven wheel is divided into two axially spaced parts which receive the other of said driving wheel and said driven wheel therebetween.

9. Apparatus as in claim 5 further comprising an axial cam disc which is movable axially in response to movement of said first coupling element, an entraining sleeve concentric to said first camshaft and movable axially in response to movement of said axial cam disc, said sleeve having internal helical teeth which cooperate with external helical teeth on said first camshaft and external helical teeth which cooperate with internal helical teeth on a driving element to which said driving wheel is fixed.

10. Apparatus as in claim 1 wherein one of said camshafts determines opening movement of said valve and the other camshaft controls closing movement of said valve.

11. Apparatus as in claim 1 wherein said driving wheel is fixed to said first camshaft.

12. Apparatus as in claim 1 wherein said driven wheel is fixed to said second camshaft.

* * * * *